US006217277B1

(12) United States Patent
Liu et al.

(10) Patent No.: US 6,217,277 B1
(45) Date of Patent: Apr. 17, 2001

(54) TURBOFAN ENGINE INCLUDING IMPROVED FAN BLADE LINING

(75) Inventors: Xiaoliu Liu, Mississauga; John Angus Raw, Qualicum Beach, both of (CA)

(73) Assignee: Pratt & Whitney Canada Corp., Longueuil (CA)

( * ) Notice: Subject to any disclaimer, the term of this patent is extended or adjusted under 35 U.S.C. 154(b) by 0 days.

(21) Appl. No.: 09/412,642

(22) Filed: Oct. 5, 1999

(51) Int. Cl.[7] ..... F01B 25/16

(52) U.S. Cl. ..... 415/9; 415/173.3; 415/173.4; 415/174.4

(58) Field of Search ..... 415/173.1, 173.3, 415/173.4, 174.2, 174.4, 229; 416/174

(56) References Cited

U.S. PATENT DOCUMENTS

| | | | |
|---|---|---|---|
| 4,398,508 | 8/1983 | Moon et al. . | |
| 4,411,594 | * 10/1983 | Pellow et al. | 415/173.1 |
| 4,957,411 | 9/1990 | Girault . | |
| 5,655,701 | 8/1997 | Quattrocchi et al. . | |
| 5,700,011 | 12/1997 | Bainachi et al. . | |
| 5,941,685 | 8/1999 | Bagepalli et al. . | |

FOREIGN PATENT DOCUMENTS

| | | |
|---|---|---|
| 0 947 746 | 10/1999 | (EP) . |
| 2333137 | 7/1999 | (GB) . |

* cited by examiner

*Primary Examiner*—Edward K. Look
*Assistant Examiner*—Hermes Rodriguez
(74) *Attorney, Agent, or Firm*—Jeffrey W. Astle

(57) ABSTRACT

An improved rotary engine, engine lining and engine casing and lining combination are disclosed. The engine is preferable a turbofan engine and includes a fan blade, rotatably mounted within a generally cylindrical casing for rotation about a lengthwise extending central axis. An annular lining is mounted within the casing between a tip of the fan blade and the casing. The lining seals the tip of the fan blade within the casing. The lining includes a brush seal that extends around an inner circumference of the casing, and has a plurality of bristles that extend radially inward from the seal. A retaining membrane extends around the brush seal, preventing the bristles from extending substantially in a radial direction from the brush seal. The retaining membrane is adapted to release the bristles to extend radially inward to occupy a region between the tip of the fan blade and the casing upon a radial excursion of the fan blade. The bristles, once released, at least partially seal the tip of the fan blade and the casing reducing air recirculation at the blade tip.

29 Claims, 5 Drawing Sheets

TURBOFAN ENGINE INCLUDING IMPROVED FAN BLADE LINING

FIELD OF THE INVENTION

The present invention relates to rotary engines, and more particularly to turbofan engines having a fan blade lining including a hidden brush seal.

BACKGROUND OF THE INVENTION

In most turbofan engines, a lining is mounted between the engine casing and the first compressor stage or fan blade. The lining provides a tight clearance between the tip of the fan blade and the casing. In order to minimize the consequence of inadvertent contact between the rotating fan blade and the lining, the lining is formed from a material that may be abraded by the blade, and is often referred to as an abradable. An example abradable is disclosed in U.S. Pat. No. 5,655,701.

In the event the blade is struck by a foreign object, such as a bird entering the air intake of the engine, the fan blade may make a radial excursion coming into contact with the lining. As a result of the radial excursion, the lining is shorn by the fan blade tip. For a foreign object of significant size, up to 0.3" (0.8 cm) of the abradable may be shorn. This, in turn, significantly increases the blade tip clearance, and may cause air recirculation at the blade tip. As a result the fan blade may stall at its outer span, causing serious consequences to the engine, such as engine surges.

Often, engine casings include slots extending into the compressor section near the fan blan. These slots increase the clearance margin before the tip of the blade stalls (referred to as stall margin). However, these slots also reduce overall engine performance.

Accordingly, an improved lining, reducing susceptibility of the engine to consequences of radial excursions of a fan blade is desirable.

SUMMARY OF THE INVENTION

It is an object of the present invention to provide an improved rotary engine and an improved fan blade lining for the casing of a rotary engine.

In accordance with an embodiment of the present invention, an engine includes a fan blade, rotatably mounted within a generally cylindrical casing for rotation about a lengthwise extending central axis of the engine. An annular lining is mounted within the casing between a tip of the fan blade and the casing. The lining includes a brush seal that extends around an inner circumference of the casing, and has a plurality of bristles that extend radially inward from the seal. A retaining membrane extends around the brush seal, and prevents the bristles from extending substantially in a radial direction from the brush seal. The retaining membrane is adapted to release the bristles to occupy a radial region between the tip of the fan blade and the casing upon a radial excursion of the fan blade. The bristles, once released, at least partially seal the tip of the fan blade. The invention may be embodied in a rotary engine; and engine lining; or the combination of an engine casing and lining.

Other aspects and features of the present invention will become apparent to those of ordinary skill in the art upon review of the following description of specific embodiments of the invention in conjunction with the accompanying figures.

BRIEF DESCRIPTION OF THE DRAWINGS

In figures, which illustrate by way of example only, embodiments of the present invention.

DETAILED DESCRIPTION

Figure 1:
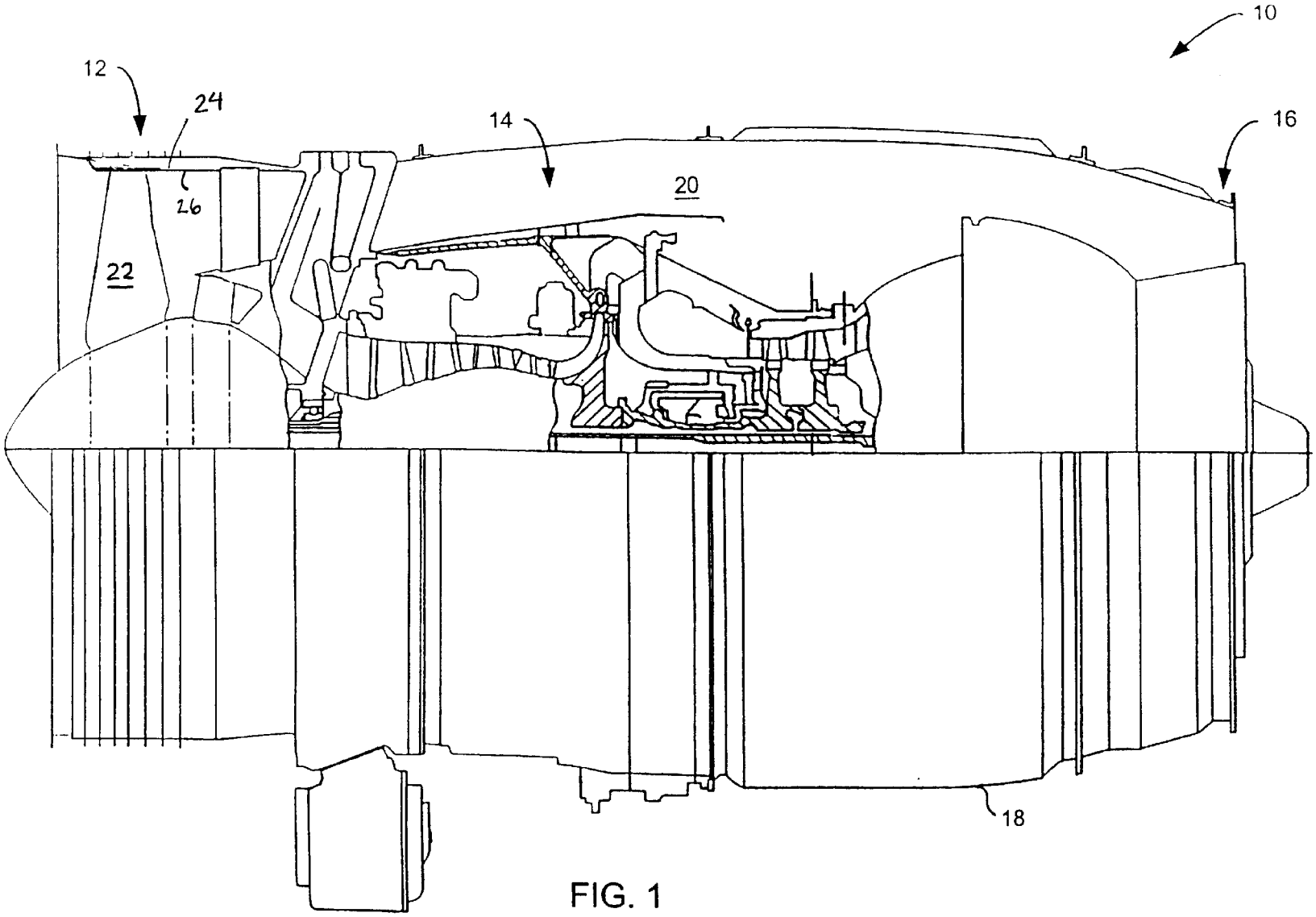
FIG. 1 is a partial cross-sectional view of a rotary engine, exemplary of an embodiment of the present invention.

FIG. 1 illustrates a turbofan engine 10, exemplary of an embodiment of the present invention. Engine 10 includes, from front to rear a conventional fan section 12; conventional core engine section 14, including at least one axial compressor, combustion section, and at least one turbine; and a conventional exhaust section 16, all mounted within a generally cylindrical casing 18. A by-pass duct 20, extends about core engine section 14, within casing 18.

As illustrated, fan section 12 includes a rotatable fan blade 22, mounted for axial rotation about a main central axis of engine 10. A lining 24 including a conventional abradable 26 extends circumferentially about the interior of casing 18, between casing 18 and the tip of fan blade 22. Abradable 26 is made of a conventional material, such as an epoxy potting compound and may be bonded to the interior of casing 18. The tip of fan blade 22 extends in close proximity to abradable 26. Abradable 26 thus seals the tip of fan blade 22 within casing 18.

Figure 2A:
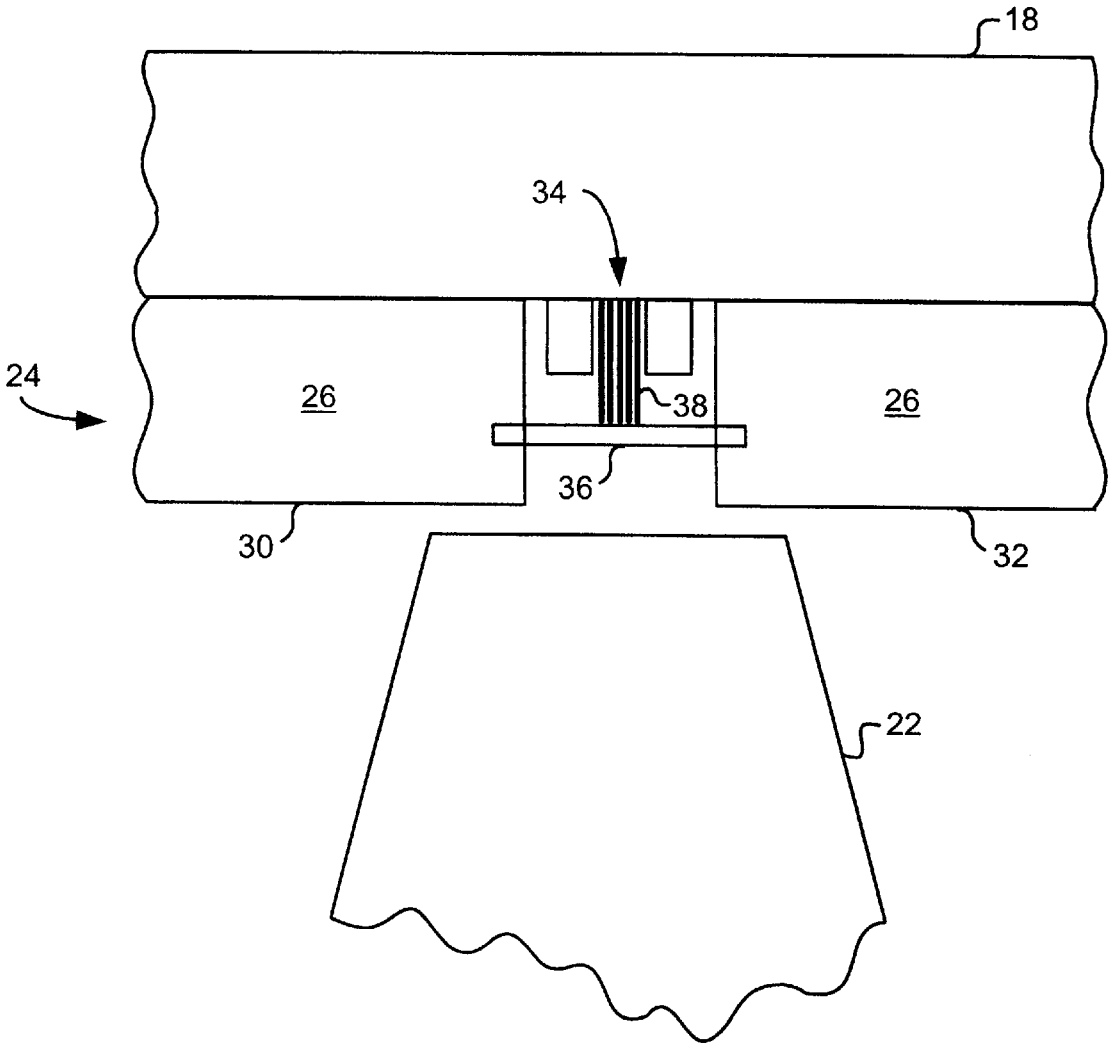
FIG. 2A is a further enlarged view of a portion of FIG. 1.
Figure 2B:
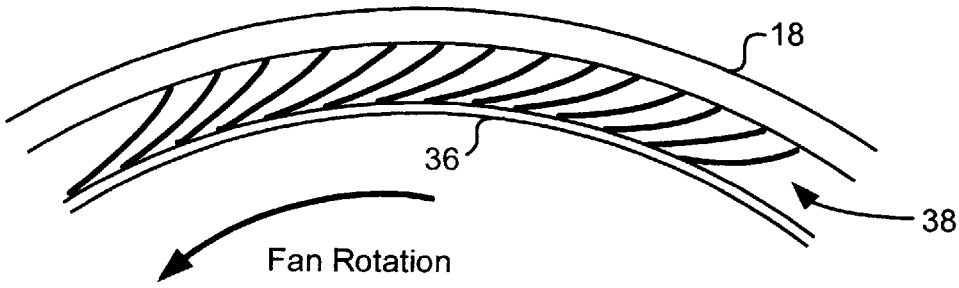
FIG. 2B is a front view of a portion the engine of FIG. 1, in cross section.

FIG. 2A illustrates an enlarged view of a portion of FIG. 1, more particularly illustrating lining 24. As illustrated, the region of liner 24 occupied by abradable 26 is made up of two portions, a front and aft portion 30 and 32. Mounted between front and aft abradable portions 30 and 32 is a hidden brush seal 34, retained between portions 30 and 32 by a retaining membrane 36. Brush seal 34 includes a plurality bristles 38, hidden by membrane 36. These are compressed in a direction generally tangent to the outer circumference of casing 18 by membrane 36 as best illustrated in FIG. 2B. For reasons that will become apparent, the bristles 38 of brush seal 34 are cocked in a direction, generally tangent to the rotation of fan blade 22, at a relatively large angle. Preferably brush seal 34, and in particular bristles 38 may be made of a cobalt based alloy, such as HAYNES-25. Membrane 36 is preferably a ring formed of an easily breakable material, such as plastic, and may be partially embedded in abradable portions 30 and 32. Lining 24 including brush seal 34 and abradable 26 may be affixed to the casing 18 by bonding, bolting, brazing or in any other suitable manner known to those of ordinary skill in the art.

In normal, steady-state, operation fan blade 22 draws air into a compressor section of core engine section 14, of engine 10 (FIG. 1). Similarly, blade 22 draws air through by-pass duct 20, about the main engine section 14. Compressed air exits the compressor section and enters the combustion chamber (not shown) where it is admixed with fuel. The fuel and air mixture is combusted, and exits the rear of the combustion chamber to at least one turbine, coupled to cause fan blade 22 to rotate. Exhaust gases are discharged through exhaust section 16.

In normal operation, abradable 26 seals the tip of fan blade 22 within casing 18, thereby preventing recirculation of air at its tip.

Figure 3A:
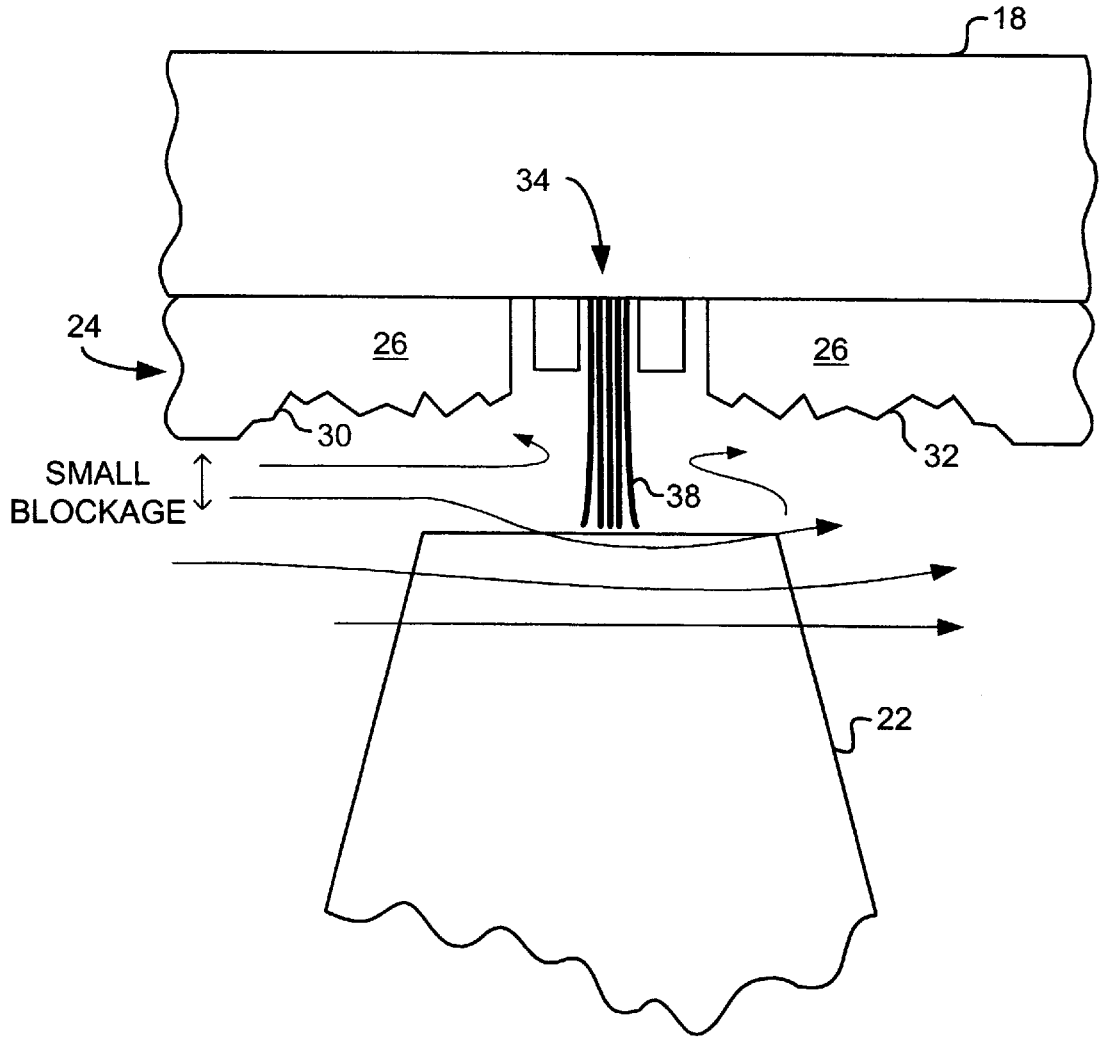
FIG. 3A illustrates the view of FIG. 2A after a radial excursion of a fan of the engine of FIG. 1.
Figure 3B:
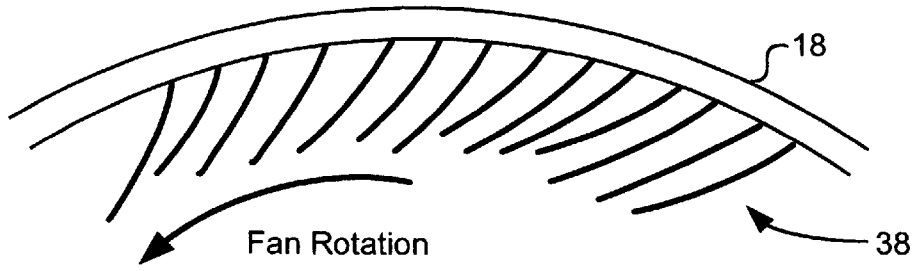
FIG. 3B illustrates the front view of FIG. 2B after the radial excursion of a fan blade of the engine of FIG. 1.

Now, if fan blade 22 is struck by a foreign object, such as for example a bird, fan blade 22 may undergo a radial excursion. Of course, this will depend on the relative size of the foreign object to fan blade 22 and engine 10. Two one (1) pound birds, for example, may cause as much as a 0.3" (0.8 cm) radial excursion for a typical fan blade. This radial excursion causes fan blade 22 to contact abradable 26 and shear or tear abradable 26, as illustrated in FIG. 3A. Similarly, membrane 36 is at least partially torn by fan blade 22, undergoing its radial excursion. Once membrane 36 is torn, some or all of the hidden bristles 38 of brush seal 34 become liberated. Advantageously, membrane 36 and abradable 26 buffer the impact of fan blade 22, limiting damage caused by fan blade 22 to brush seal 34. As membrane 36 cocks bristles 38 in the direction of rotation of fan 20, and bristles 38 are flexible, they are not immediately cut by rotating fan 20. Instead, the bristles 38 of brush seal 34 extend radially inward gradually, and particularly once fan blade 22 has completed its radial excursion and is again centered about its axis of rotation, as best illustrated in FIG. 3B. The liberated bristles 38 of brush seal 34 now occupy much of the radial gap formerly occupied by abradable 26. As will be appreciated, depending on the nature of the radial excursion, not all areas of lining 24 need be contacted by fan blade 22. Instead only, a portion of lining 24 and membrane 36 may be shorn, and only some of the bristles 38 may be liberated. In any event, as a result of the liberated bristles 38, recirculation at the fan tip is reduced or eliminated. Similarly, any associated stalling of the fan at its outer span and any resulting engine surge is reduced or eliminated, so that an aircraft can land safely after the foreign object has struck.

As should be appreciated, once membrane 36 is broken, engine 10 should be serviced to replace or repair lining 24. As will further be appreciated, constant contact between the tip of fan blade 22 and bristles 38 will cause bristles 38 to wear.

Figure 4A:
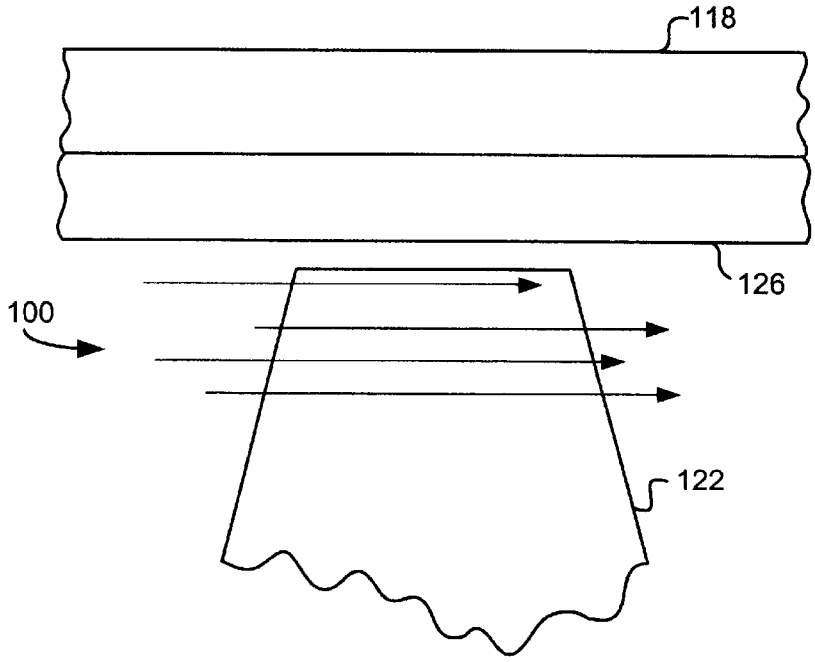
FIG. 4A (PRIOR ART)
FIG. 4A illustrates an enlarged view of a portion of a conventional turbofan engine, similar to the view of FIG. 2A.
Figure 4B:
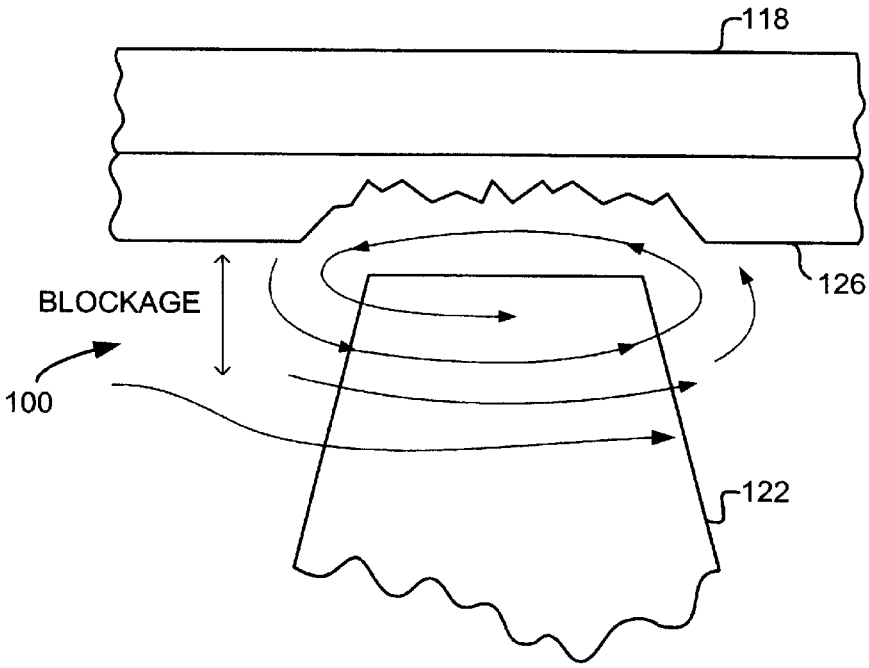
FIG. 4B (PRIOR ART)
FIG. 4B illustrates an enlarged view of a portion of the conventional turbofan engine of FIG. 4A, similar to the view of FIG. 3A.

The operation of exemplary engine 10, and recirculation of air at the tip of its fan blade 22 may be better appreciated with reference to FIGS. 4A and 4B illustrating a portion of a conventional turbofan engine 100, similar to the portion of turbofan engine 10 illustrated in FIGS. 2A and 3A. As illustrated, the conventional turbofan includes fan blade 122, and an abradable 126 mounted within casing 118. Engine 100, however, does not include lining including a membrane and hidden brush seal. In normal operation, air is drawn into engine 100, as illustrated in FIG. 4A. Upon a radial excursion of blade 122, as illustrated in FIG. 4B, abradable 118 is shorn, causing air to recirculate at the tip of blade 122. This, recirculating air causes a blockage region near the tip of blade 122, as illustrated. In this region, air cannot be adequately drawn into the engine 100, thereby potentially causing the engine to stall. In exemplary engine 10, on the other hand the extension of brush seal 38 reduces recirculation at the tip of fan blade 22 thereby reducing the size of the blocked region and reducing the likelihood of stall, as illustrated in FIG. 3A.

Figure 5:
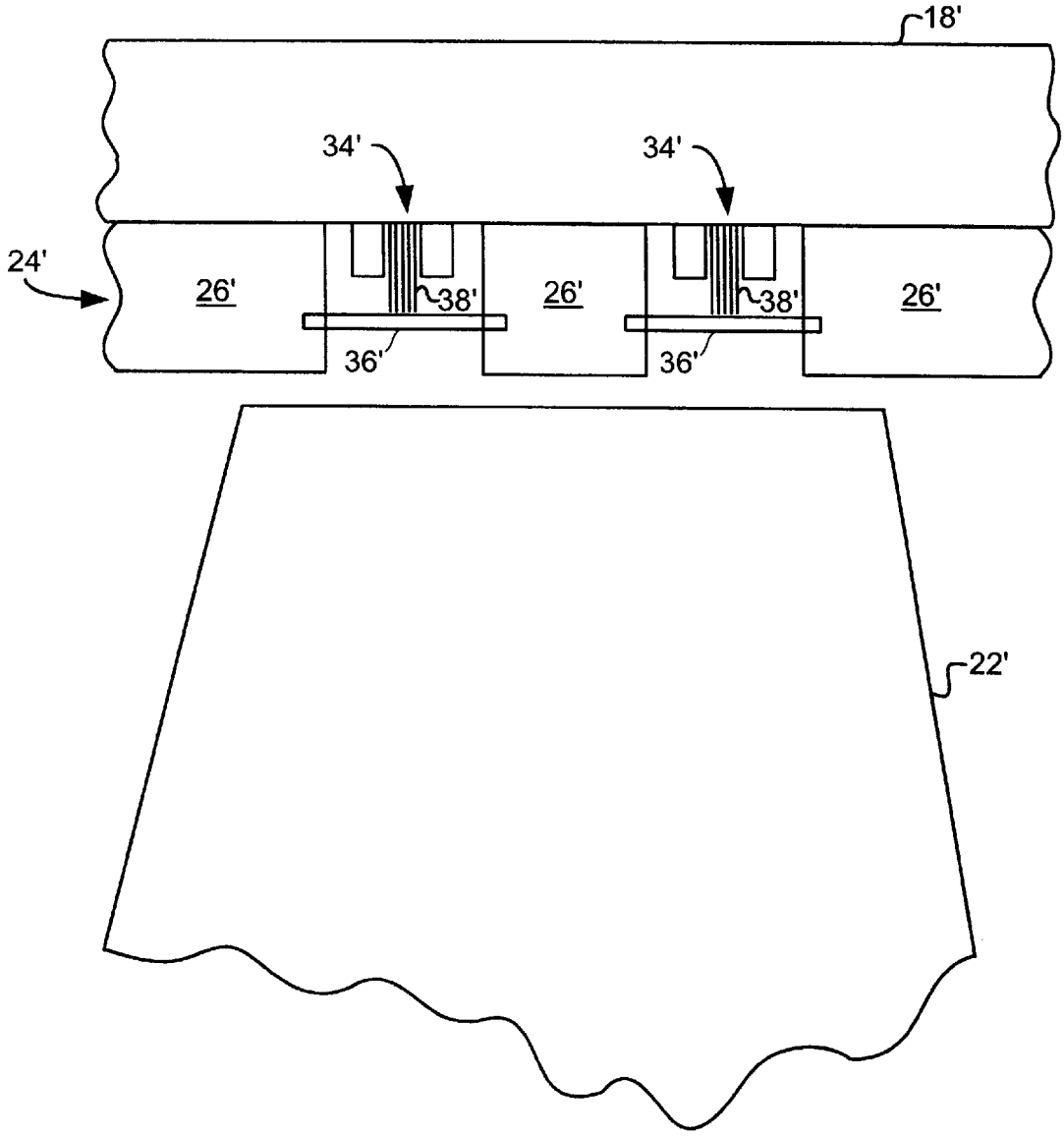
FIG. 5 is an enlarged cut-away view of another engine, exemplary of a second embodiment of the present invention.

In a second embodiment illustrated in FIG. 5, several brush seals 34' may be combined in a single lining 24'. As illustrated two or more brush seals mounted 34' including bristles 38' form part of lining 24' and are mounted beside each other, also circumferentially about casing 18' at the tip of fan blade 22'. Abradable 26' made of three regions also form part of lining 24'. The bristles 38' of the multiple brush seals 34' may all be retained and released by membrane, formed of membrane portions 36'*a* and 36'*b* in a manner analogous to bristles 38 of membrane 36 (as illustrated in FIGS. 2A, 2B, 3A and 3B).

As will be appreciated lining 24 (or 24') and casing 18 may be combined in an article of manufacturer produced by a casing supplier, into which the remainder of engine 10 may be inserted.

The above described embodiments are intended to be illustrative only, and in no way limiting. The embodiments are susceptible to many modifications of form, size, arrangement of parts and details of operation. For example, while retaining membranes 36 and 36' have been described as breaking upon radial excursion of fan blade 22 and 22', these membranes could be otherwise adapted to release bristles 38 and 38'. For example, membrane 38 could be retractable.

The invention, rather, is intended to encompass all such modification within its scope as defined by the claims.

What is claimed is:

1. A rotary engine comprising:

a generally cylindrical casing;

a fan blade, rotatably mounted within said casing for rotation about a lengthwise extending central axis of said engine;

an annular lining mounted within said casing between a tip of said fan blade and said casing, sealing said tip of said fan blade within said casing, said lining comprising:

a brush seal, extending around an inner circumference of said casing, comprising a plurality of bristles extending radially inward from said brush seal;

a retaining membrane extending around said brush seal, preventing said bristles from extending substantially in a radial direction from said brush seal;

whereby said retaining membrane is adapted to release said bristles to extend radially inward and occupy a region between said tip of said fan blade and said casing to at least partially seal said tip of said fan blade within said casing upon a radial excursion of said fan blade.

2. The rotary engine of claim 1, wherein said retaining membrane may be broken by a radial excursion of said fan blade.

3. The rotary engine of claim 2, wherein said lining further comprises an abradable region, extending around an inner circumference of said casing, adjacent to said brush seal.

4. The rotary engine of claim 3, wherein said abradable region extends around said inner circumference of said casing, adjacent to said brush seal, before and aft of said brush seal along a length of said casing.

5. The rotary engine of claim 2, wherein said retaining membrane comprises an annular ring.

6. The rotary engine of claim 5, wherein said annular ring is formed of plastic.

7. The rotary engine of claim 6, wherein said annular ring is at least partially embedded within, and retained by said abradable region, and wherein said abradable region is shorn by said radial excursion.

8. The rotary engine of claim 7, wherein said abradable region is formed of epoxy potting compound.

9. The rotary engine of claim 2, wherein said retaining membrane retains said bristles generally tangent to said lining, in a direction tangent to a rotation of said fan blade.

10. The rotary engine of claim 2, wherein said lining further comprises:

a second brush seal, extending around said inner circumference of said lining, and having a plurality of bristles extending radially inward from said second brush seal;

and wherein said retaining membrane prevents said bristles of said second brush seal from extending substantially in a radial direction from said second brush seal;

whereby said retaining membrane is adapted to release said bristles of said second brush seal to extend radially inward and occupy a second region between said tip of said fan blade and said casing to further seal said tip of said fan blade within said casing.

11. A lining, mountable within a generally cylindrical casing of a rotary engine between a tip of a fan blade of said engine and said casing, said lining comprising:

a brush seal comprising a plurality of bristles, said brush seal extending around an inner circumference of said casing and said bristles extending radially inward from said brush seal, when said lining is mounted within said casing;

a retaining membrane extending around said brush seal, preventing said bristles from extending substantially in a radial direction from said brush seal, when said lining is mounted within said casing;

whereby said retaining membrane is adapted to release said bristles to extend radially inward and occupy a region between said tip of said fan blade and said casing to at least partially seal said tip of said fan blade within said casing upon a radial excursion of said fan blade.

12. The lining of claim 11, wherein said retaining membrane may be broken by a radial excursion of said fan blade.

13. The lining of claim 12, further comprising an abradable region, extending adjacent to said brush seal around an inner circumference of said casing, when said lining is mounted within said casing.

14. The lining of claim 13, wherein said abradable region extends around said inner circumference of said casing, adjacent to said brush seal, before and aft of said brush seal along a length of said casing when said lining is mounted within said casing.

15. The lining of claim 13, wherein said membrane is embedded and retained by said abradable region.

16. The lining of claim 15, wherein said abradable region is formed of epoxy potting compound.

17. The lining of claim 12, wherein said retaining membrane is formed of plastic.

18. The lining of claim 12, wherein said retaining membrane retains said bristles generally tangent to said lining, in a direction tangent to a rotation of said fan blade, when said lining is mounted within said casing.

19. The lining of claim 12, further comprising:

a second brush seal, extending around said inner circumference of said lining, and having a plurality of bristles extending radially inward from said second brush seal, when said lining is mounted within said casing;

and wherein said retaining membrane prevents said bristles of said second brush seal from extending substantially in a radial direction from said second brush seal;

whereby said retaining membrane is adapted to release said bristles of said second brush seal to extend radially inward and occupy a second region between said tip of said fan blade and said casing to further seal said tip of said fan blade within said casing.

20. A rotary engine comprising:

a generally cylindrical casing;

a fan blade, rotatably mounted within said casing for rotation about a lengthwise extending central axis of said engine;

an annular lining mounted within said casing between a tip of said fan blade and said casing, said lining comprising:

a brush seal, extending around an inner circumference of said casing, comprising a plurality of bristles extending radially inward from said brush seal;

means for preventing said bristles from extending substantially in a radial direction from said brush seal, and releasing said bristles to extend radially inward between said tip of said fan blade and said casing upon a radial excursion of said fan blade, to at least partially seal said tip of said fan blade within said casing.

21. An article of manufacture, comprising:

a generally cylindrical casing for a rotary engine; and an annular lining mounted within said casing to rest between a tip of a fan blade of said rotary engine and said casing, sealing said tip of said fan blade within said casing, said lining comprising:

a brush seal, extending around an inner circumference of said casing, comprising a plurality of bristles extending radially inward from said brush seal;

a retaining membrane extending around said brush seal, preventing said bristles from extending substantially in a radial direction from said brush seal;

whereby said retaining membrane is adapted to release said bristles to extend radially inward and occupy a region between said tip of said fan blade and said casing to at least partially seal said tip of said fan blade within said casing upon a radial excursion of said fan blade.

22. The article of manufacture of claim 21, wherein said retaining membrane may be broken by a radial excursion of said fan blade.

23. The article of manufacture of claim 22, wherein said liner further comprises an abradable region, extending adjacent to said brush seal around an inner circumference of said casing.

24. The article of manufacture of claim 23, wherein said abradable region extends around said inner circumference of said casing, adjacent to said brush seal, before and aft of said brush seal along a length of said casing.

25. The article of manufacture of claim 22, wherein said membrane is embedded and retained by said abradable region.

26. The article of manufacture of claim 22, wherein said abradable region is formed of epoxy potting compound.

27. The article of manufacture of claim 22, wherein said retaining membrane is formed of plastic.

28. The article of manufacture of claim 22, wherein said retaining membrane retains said bristles generally tangent to said lining, in a direction tangent to a rotation of said fan blade.

29. The article of manufacture of claim 22, further comprising:

a second brush seal, extending around said inner circumference of said lining, and having a plurality of bristles extending radially inward from said second brush seal, when said lining is mounted within said casing;

and wherein said retaining membrane prevents said bristles of said second brush seal from extending substantially in a radial direction from said second brush seal;

whereby said retaining membrane is adapted to release said bristles of said second brush seal to extend radially inward and occupy a second region between said tip of said fan blade and said casing to further seal said tip of said fan blade within said casing.

* * * * *